US009140246B2

(12) United States Patent
Conley et al.

(10) Patent No.: US 9,140,246 B2
(45) Date of Patent: Sep. 22, 2015

(54) LANCE PUMP HAVING VERTICALLY MOUNTED STEPPER MOTOR

(75) Inventors: Paul G. Conley, St. Charles, MO (US); Brad Allen Edler, Waterloo, IL (US)

(73) Assignee: Lincoln Industrial Corporation, St. Louis, MO (US)

( * ) Notice: Subject to any disclaimer, the term of this patent is extended or adjusted under 35 U.S.C. 154(b) by 405 days.

(21) Appl. No.: 13/423,978

(22) Filed: Mar. 19, 2012

(65) Prior Publication Data

US 2013/0243609 A1 Sep. 19, 2013

(51) Int. Cl.
*F04B 23/02* (2006.01)
*F04B 49/06* (2006.01)

(52) U.S. Cl.
CPC ..... *F04B 23/028* (2013.01); *F04B 49/06* (2013.01); *F04B 2203/0209* (2013.01); *F04B 2205/05* (2013.01); *F04B 2205/09* (2013.01)

(58) Field of Classification Search
CPC . F04B 49/08; F04B 49/065; F04B 2203/0209
USPC ..... 417/44.2, 63, 551.1, 551.2
See application file for complete search history.

(56) References Cited

U.S. PATENT DOCUMENTS

| | | | |
|---|---|---|---|
| 2,187,684 | A | 1/1940 | Fox et al. |
| 2,569,110 | A | 9/1951 | McGillis et al. |
| 2,627,320 | A | 2/1953 | Rotter |
| 2,636,441 | A | 4/1953 | Woelfer |
| 2,787,225 | A | 4/1957 | Rotter |
| 3,113,282 | A | 12/1963 | Coleman |
| 3,409,165 | A | 11/1968 | Creith |
| 3,437,771 | A | 4/1969 | Nusbaum |
| 3,469,532 | A | 9/1969 | Wegmann et al. |
| 3,502,029 | A | 3/1970 | Halladay |
| 3,510,234 | A | 5/1970 | Wolf |

(Continued)

FOREIGN PATENT DOCUMENTS

| | | | |
|---|---|---|---|
| DE | 9412699 | U1 | 12/1995 |
| DE | 19623537 | A1 | 12/1997 |

(Continued)

OTHER PUBLICATIONS

International Search Report for related Application No. PCT/US2013/030464 dated Sep. 27, 2013, 4 pages.

(Continued)

*Primary Examiner* — Charles Freay
*Assistant Examiner* — Kenneth J Hansen
(74) *Attorney, Agent, or Firm* — Senniger Powers LLP

(57) ABSTRACT

A pump includes a pump body and an elongate tube. The pump includes an elongate core slidably received in the tube, a stepper motor having a selectively rotatable output shaft extending vertically and a transmission for effecting relative reciprocating motion between the core and the tube. The pump includes an inlet check valve mounted inside the core defining with the core an expansible and contractible lower pump chamber. The inlet check valve is oriented to open during each upward pumping stroke. The pump includes an annular upper chamber above the lower pump chamber and a lateral passage connecting the lower pump chamber to the annular upper chamber. The lateral passage has a check valve oriented to open during each downward pumping stroke. The pump includes an outlet passage connected to the annular upper chamber permitting viscous liquid to flow to the outlet passage on each upward and downward pumping stroke.

10 Claims, 12 Drawing Sheets

(56) References Cited

U.S. PATENT DOCUMENTS

| | | | | |
|---|---|---|---|---|
| 3,945,772 | A | 3/1976 | Van de Moortele | |
| 4,069,835 | A | 1/1978 | Stadler | |
| 4,243,151 | A | 1/1981 | Bruening | |
| 4,249,868 | A | 2/1981 | Kotyk | |
| 4,487,340 | A | 12/1984 | Shaffer | |
| 4,575,313 | A * | 3/1986 | Rao et al. | 417/26 |
| 4,718,824 | A | 1/1988 | Cholet et al. | |
| 4,735,048 | A | 4/1988 | Gregory | |
| 4,762,474 | A | 8/1988 | Dartnall | |
| 5,022,556 | A | 6/1991 | Dency et al. | |
| 5,025,827 | A | 6/1991 | Weng | |
| 5,178,405 | A | 1/1993 | Brandstadter | |
| 5,188,519 | A | 2/1993 | Spulgis | |
| 5,685,331 | A | 11/1997 | Westermeyer | |
| 5,725,358 | A * | 3/1998 | Bert et al. | 417/44.2 |
| 5,850,849 | A | 12/1998 | Wood | |
| 6,102,676 | A | 8/2000 | DiCarlo et al. | |
| 6,161,723 | A | 12/2000 | Cline et al. | |
| 6,244,387 | B1 | 6/2001 | Paluncic et al. | |
| 6,793,042 | B2 | 9/2004 | Brouillet | |
| 6,863,502 | B2 * | 3/2005 | Bishop et al. | 417/44.2 |
| 6,886,589 | B2 | 5/2005 | Oretti | |
| 2002/0157901 | A1 | 10/2002 | Kast et al. | |
| 2003/0206805 | A1 | 11/2003 | Bishop et al. | |
| 2005/0180870 | A1 | 8/2005 | Stanley et al. | |
| 2007/0253848 | A1 | 11/2007 | Lea, Jr. | |
| 2007/0289994 | A1 | 12/2007 | Kotyk | |
| 2008/0240944 | A1 | 10/2008 | Arens | |

FOREIGN PATENT DOCUMENTS

| | | | |
|---|---|---|---|
| GB | 2205905 | A | 12/1988 |
| WO | 96/41136 | A1 | 12/1996 |

OTHER PUBLICATIONS

Written Opinion for related International Application No. PCT/US2013/030464 dated Sep. 27, 2013, 7 pages.

* cited by examiner

LANCE PUMP HAVING VERTICALLY MOUNTED STEPPER MOTOR

FIELD OF THE INVENTION

This invention relates to pumps, and more particularly to an expansible chamber pump of a type which may be referred to as a lance pump or drum pump, particularly adapted for pumping lubricant, including grease, from a supply thereof (e.g., lubricant in a drum).

BACKGROUND OF THE INVENTION

The pump of this invention is in the same field as the pumps shown in the following U.S. Pat. Nos. 2,187,684; 2,636,441; 2,787,225; 3,469,532; 3,502,029; 3,945,772; 4,487,340; 4,762,474; and 6,102,676. Of particular interest is U.S. Pat. No. 2,787,225, which is directed to a lance pump sold by Lincoln Industrial Corporation of St. Louis, Mo., under the designation Series 20. Although lance pumps such as those identified above have been commercially successful, there is a need for a pump that provides a selectively variable output pressure and reduces disassembly and assembly complexity.

SUMMARY OF THE INVENTION

In one aspect, the present invention includes a pump for pumping a viscous liquid from a reservoir. The pump comprises a pump body adapted for positioning above the reservoir and an elongate tube extending downward from an upper end connected to the body, past an upper portion and a lower portion, to a lower end when the body is positioned above the reservoir. An elongate core slidably received in the tube extends vertically downward from the body into the liquid when the body is in position above the reservoir. The core has a longitudinal axis extending between an upper end mounted on the body for vertical reciprocating motion and a lower end opposite the upper end. Further, the pump includes a stepper motor mounted on the body having a selectively rotatable output shaft extending vertically above the liquid in the reservoir when the body is in position and a transmission operatively connected to the stepper motor output shaft. The transmission effects reciprocating relative motion between the tube and the core so the elongate core moves between a relative raised position and a relative lowered position as the stepper motor output shaft rotates in one direction to effect an upward pumping stroke and in an opposite direction to effect a downward pumping stroke. In addition, the pump has an inlet check valve mounted inside the core defining with the core an expansible and contractible lower pump chamber. The inlet check valve is oriented to open during each upward pumping stroke permitting viscous liquid to enter the lower pump chamber. The pump also comprises an annular upper chamber defined in part by the tube and the core above the lower pump chamber and a lateral passage in the core connecting the lower pump chamber to the annular upper chamber. The lateral passage has a check valve oriented to open during each downward pumping stroke. The pump includes an outlet passage connected to the annular upper chamber permitting viscous liquid to flow from the annular upper chamber to the outlet passage on each upward and downward pumping stroke.

In another aspect, the present invention includes a pump for pumping a viscous liquid from a reservoir. The pump comprises a pump body adapted for positioning above the reservoir and an elongate tube extending downward from an upper end connected to the body to a lower end below the upper end when the body is positioned above the reservoir. The pump also includes an elongate core slidably received in the tube and extending vertically downward from the body into the liquid when the body is in position above the reservoir. The core has a longitudinal axis extending between an upper end mounted on the body and a lower end opposite the upper end. In addition, the pump comprises an electric motor mounted on the body having a selectively rotatable output shaft for effecting relative reciprocating motion between the core and the elongate tube so the core moves between a relative raised position and a relative lowered position as the motor output shaft rotates in one direction to drive the pump through an upward pumping stroke and in an opposite direction to drive the pump through a downward pumping stroke. The pump also includes a control operatively connected to the electric motor for controlling operation of the motor and an inlet check valve mounted inside the core defining with the tube an expansible and contractible lower pump chamber. The inlet check valve is oriented to open during each upward pumping stroke permitting viscous liquid to enter the lower pump chamber. Further, the pump includes an annular upper chamber defined in part by the tube and the core above the lower pump chamber and a lateral passage in the core connecting the lower pump chamber to the annular upper chamber. The lateral passage has a check valve oriented to open during each downward pumping stroke to deliver viscous liquid from the lower pump chamber to the annular upper chamber. The pump comprises an outlet passage connected to the annular upper chamber permitting viscous liquid to flow from the annular upper chamber.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
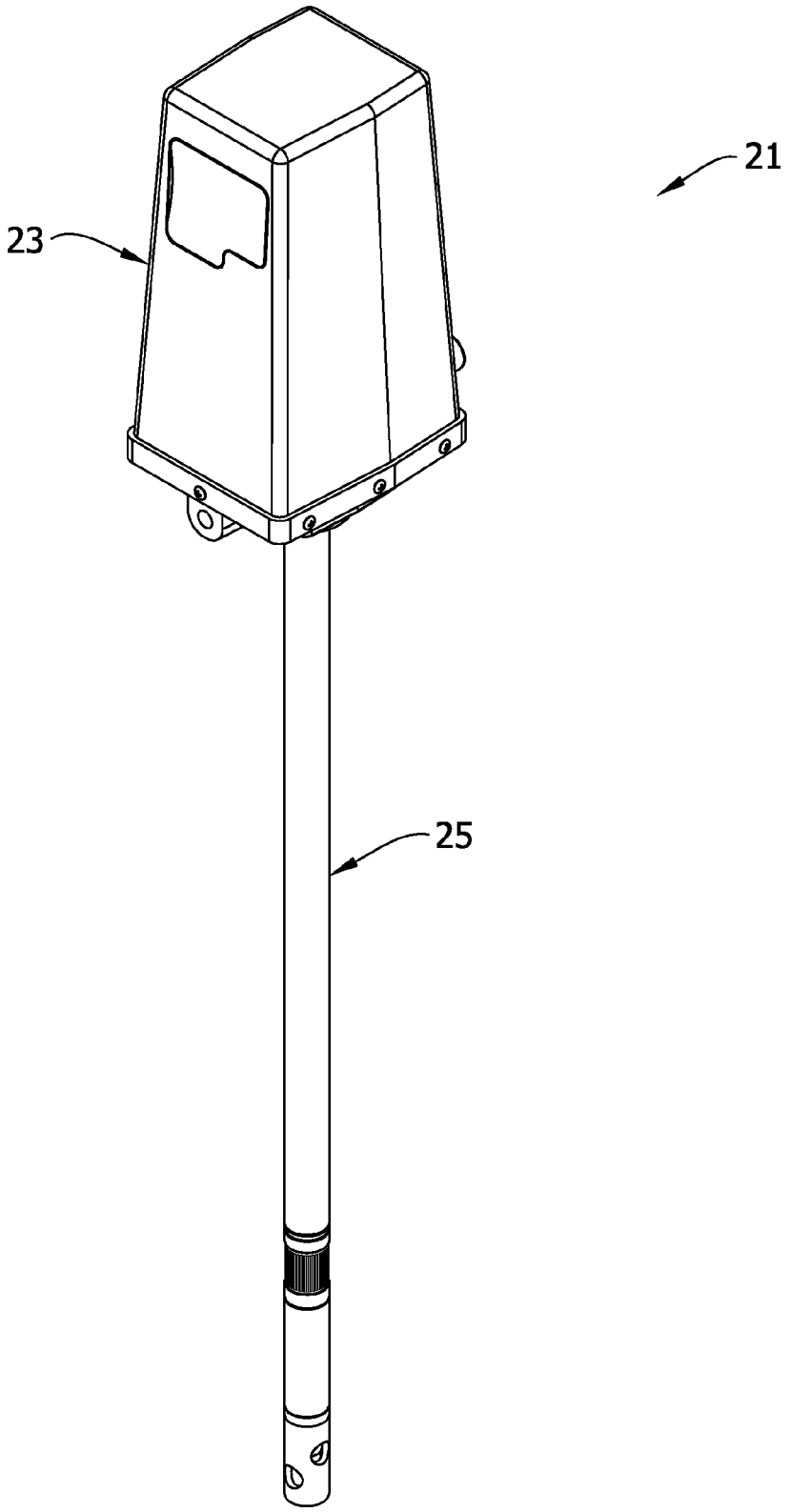
FIG. 1 is a perspective of a lance pump of one embodiment of the present invention.
Figure 2:
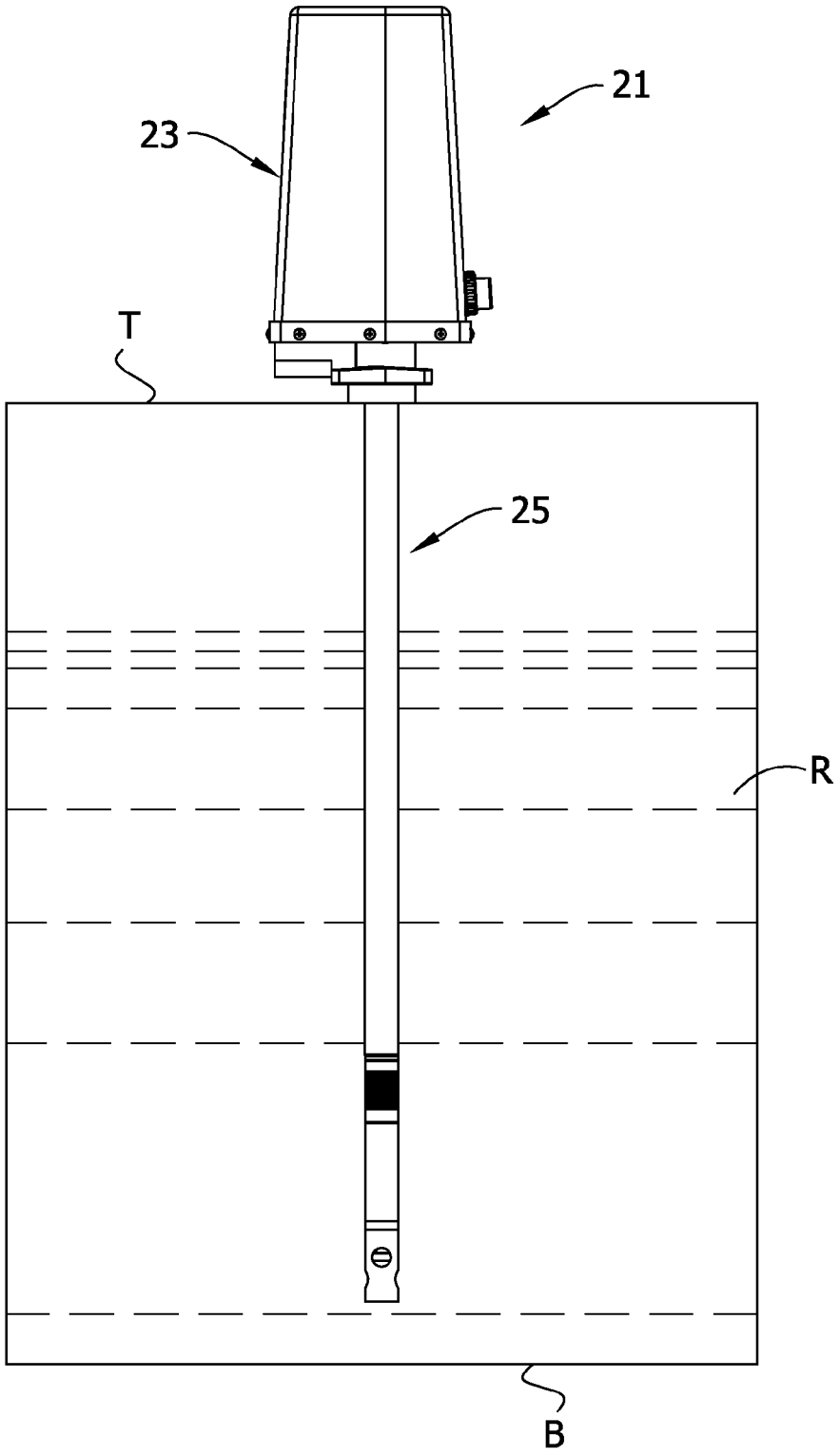
FIG. 2 is a side elevation of the lance pump mounted on a supply of lubricant.
Figure 3:
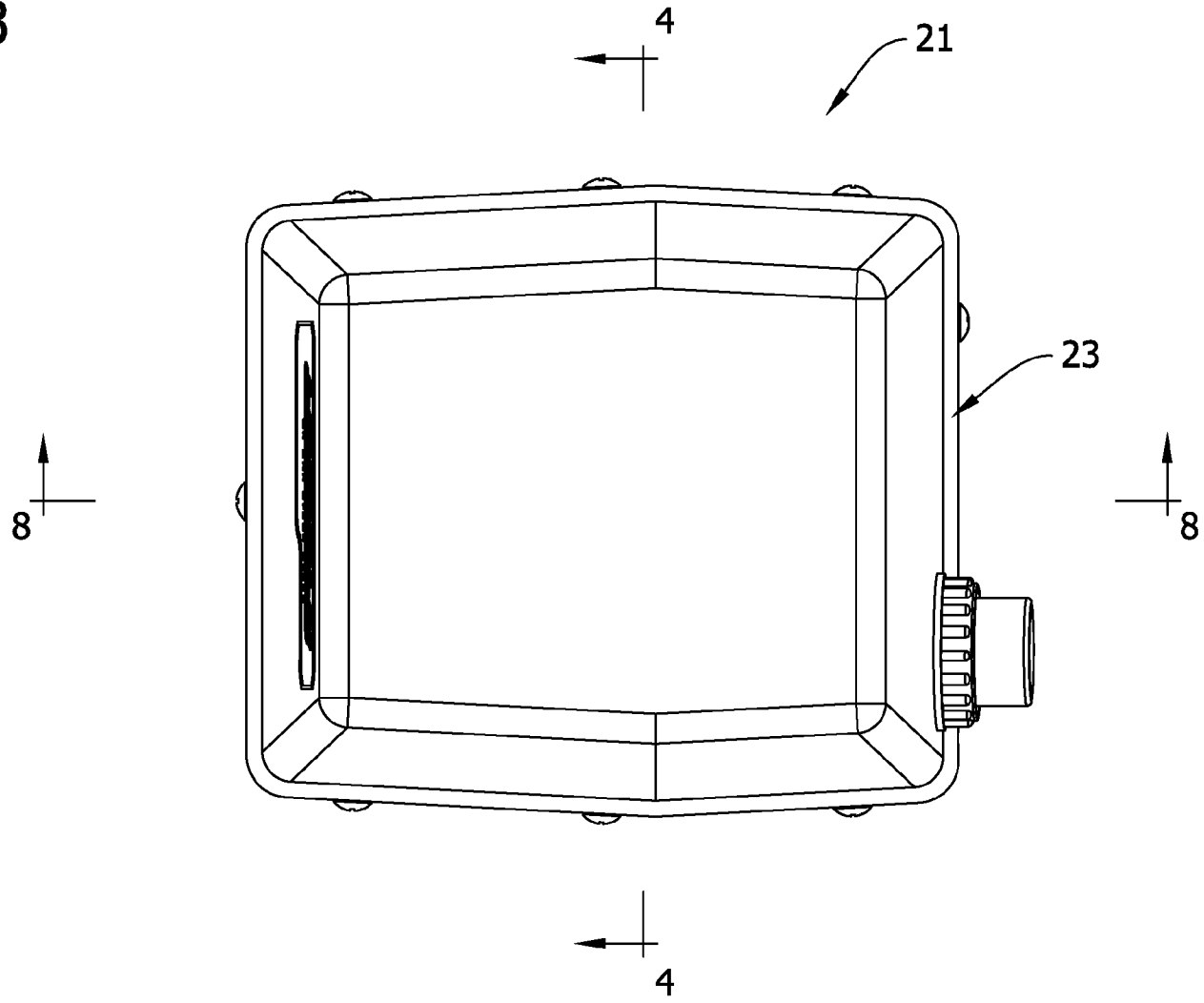
FIG. 3 is a top plan of the pump in FIG. 1.

Referring to FIGS. 1-3, a lance pump or drum pump of the present invention, constructed particularly for pumping lubricant, especially grease, from a supply, is designated in its entirety by the reference number 21. The pump 21 comprises a pump body, generally designated by 23, adapted for placement above the supply, and a lance structure, generally designated by 25, extending down from the body. The lance structure 25 is intended to extend into a supply of lubricant. As indicated in FIG. 2, the supply may be contained in a reservoir R, such as a drum, the body being mounted on the top or lid T of the drum with the lance structure 25 extending down into the drum toward the bottom B of the reservoir through a hole in the top. Although the pump 21 has been developed for pumping lubricant and especially grease, it is adapted to pump other pumpable products, particularly viscous liquids.

Referring to FIGS. 4-9, the pump 21 comprises an elongate pump tube, designated in its entirety by the reference numeral 31, extending down from an upper end fixedly connected to the body 23 to a lower end extending into the reservoir R when the pump is mounted on the top T. The pump tube 31 includes an upper tubular member 33 received in a bore 35 of the body 23, an intermediate tubular member 37 attached to a lower end of the upper tubular member opposite the body, a tubular extension member 39 attached to a lower end of the intermediate tubular member opposite the upper tubular member, and a priming tube 41 with one or more openings 42 attached to a lower end of the tubular extension member opposite the intermediate tubular member. The components of the pump tube 31 can be attached in any one of several conventional ways, such as by threaded connection. The upper tubular member 33, intermediate tubular member 37, tubular extension member 39, and priming tube 41 are co-linear on a vertical central axis of the lance structure 25. The pump tube 31 has a substantially uniform outer diameter, such that there is a smooth transition between the separate components of the pump tube.

Figure 8:
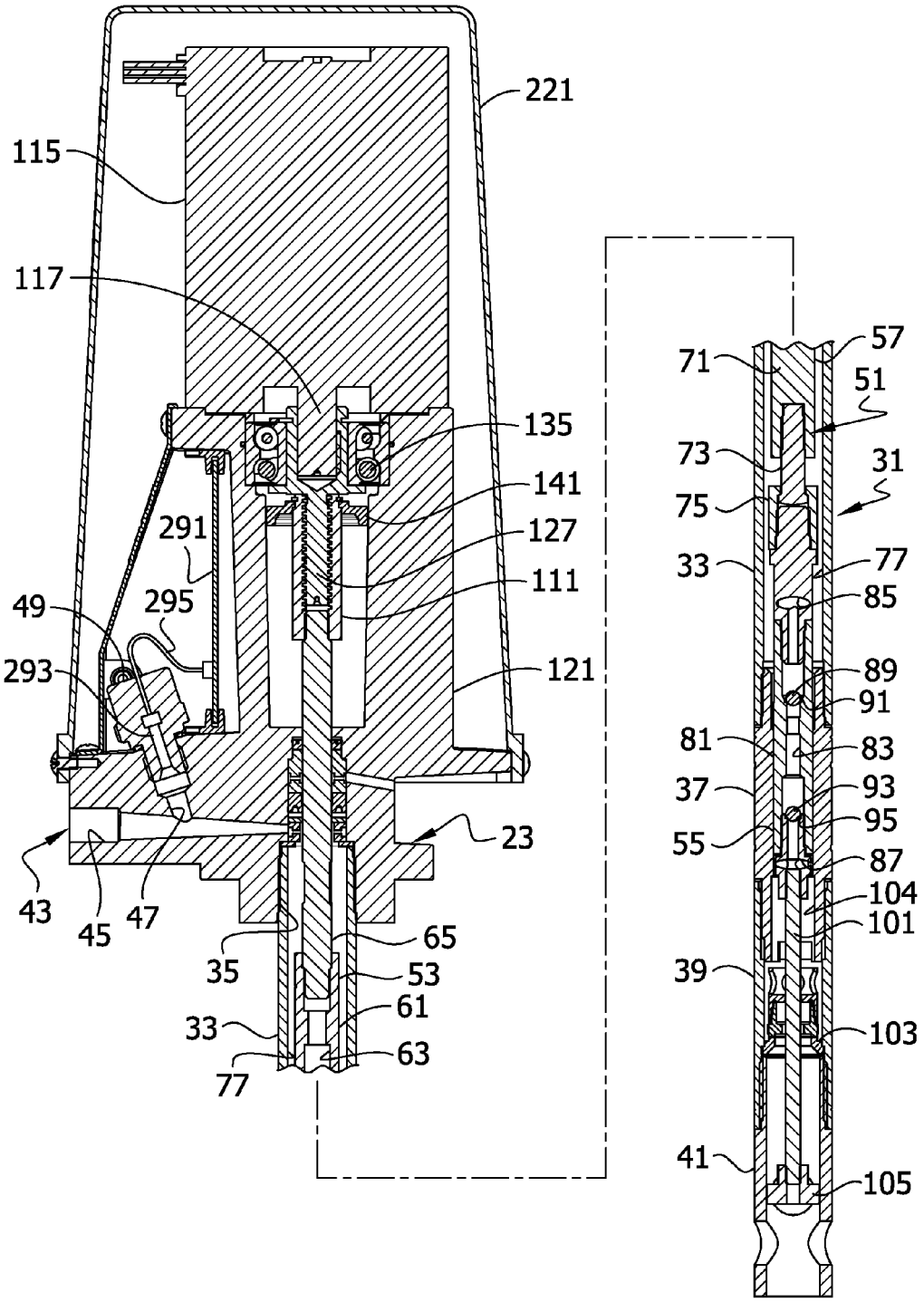
FIG. 8 is a detail similar to FIG. 6 but taken in the plane of line 8-8 of FIG. 3.
Figure 9:
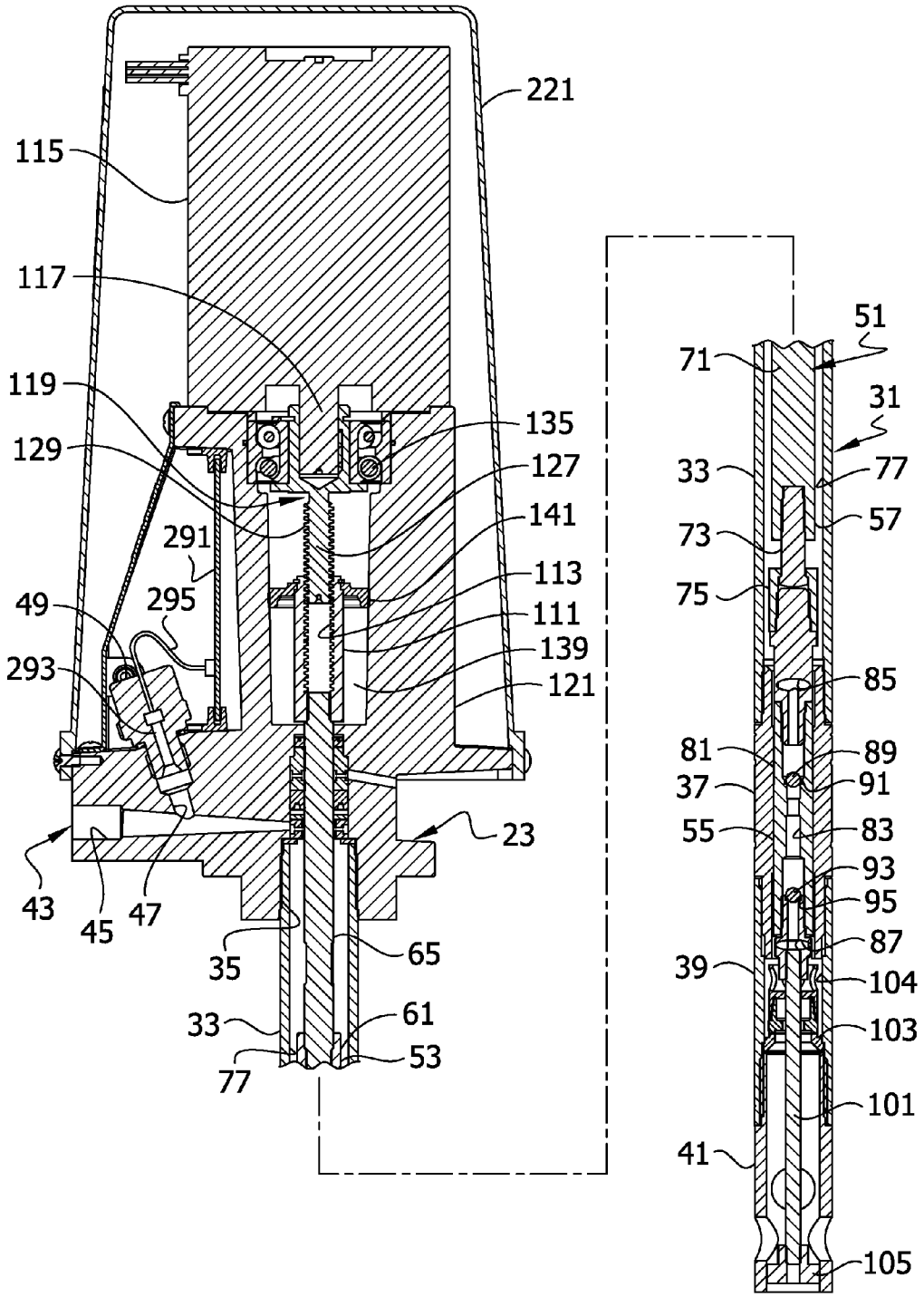
FIG. 9 is a detail similar to FIG. 8 but showing the core in a lowered position.

As illustrated in FIGS. 8 and 9, the body 23 has an outlet passage, generally designated by 43, in fluid communication with the bore 35. The outlet passage 43 includes a generally tapered portion 45 adapted to dispense viscous liquid from the pump, and a branch 47 extending at an angle from the tapered portion. The branch 47 of the outlet passage 43 holds a plug 49 capable of monitoring pressure, as will be explained below.

As further shown in FIGS. 4-9, an elongate member constituting a pump rod or core, designated in its entirety by the reference numeral 51, extends down from the body 23 and is slidably received in the pump tube 31. The core 51 has an upper end portion 53, a lower end portion 55 and an intermediate portion 57. These portions 53, 55, 57 are co-linear on a vertical central axis of the lance structure 25.

Figure 4:
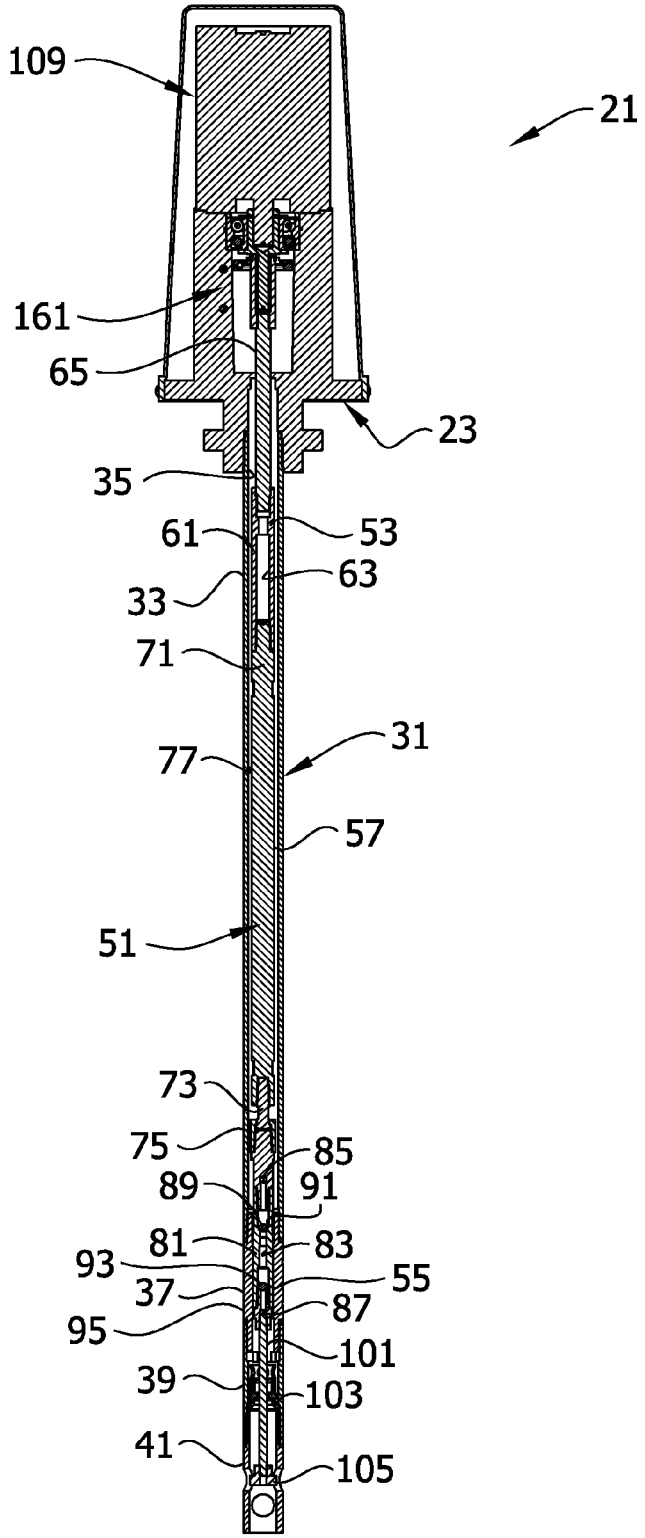
FIG. 4 is a vertical section taken in the plane of line 4-4 of FIG. 3 showing a pump core in a raised position.
Figure 5:
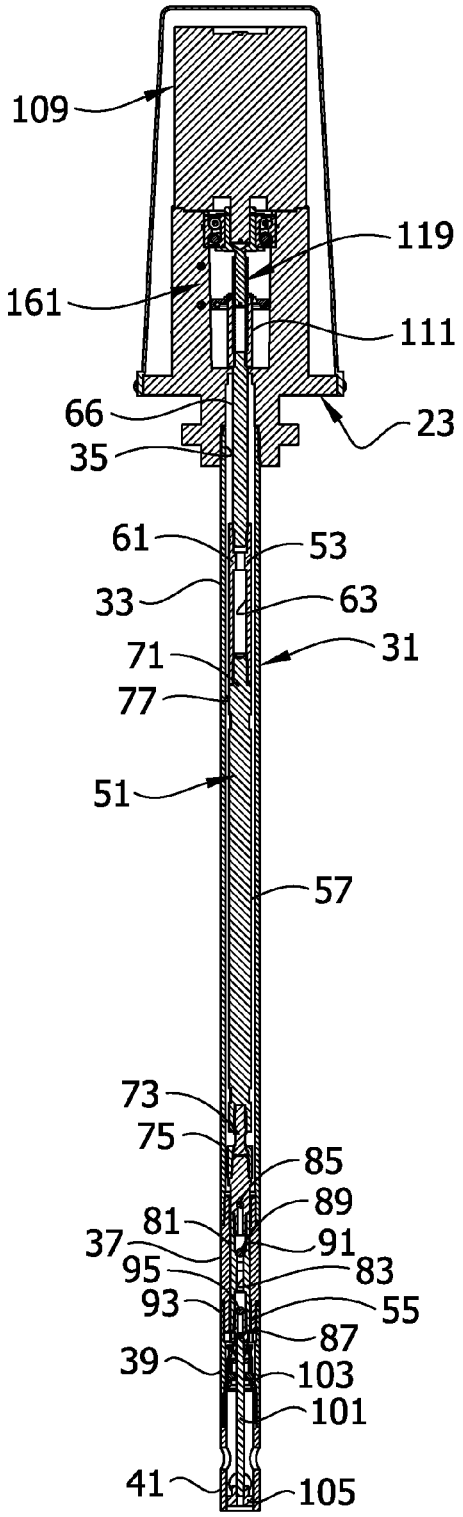
FIG. 5 is a vertical section similar to FIG. 4 but showing the core in a lowered position.
Figure 6:
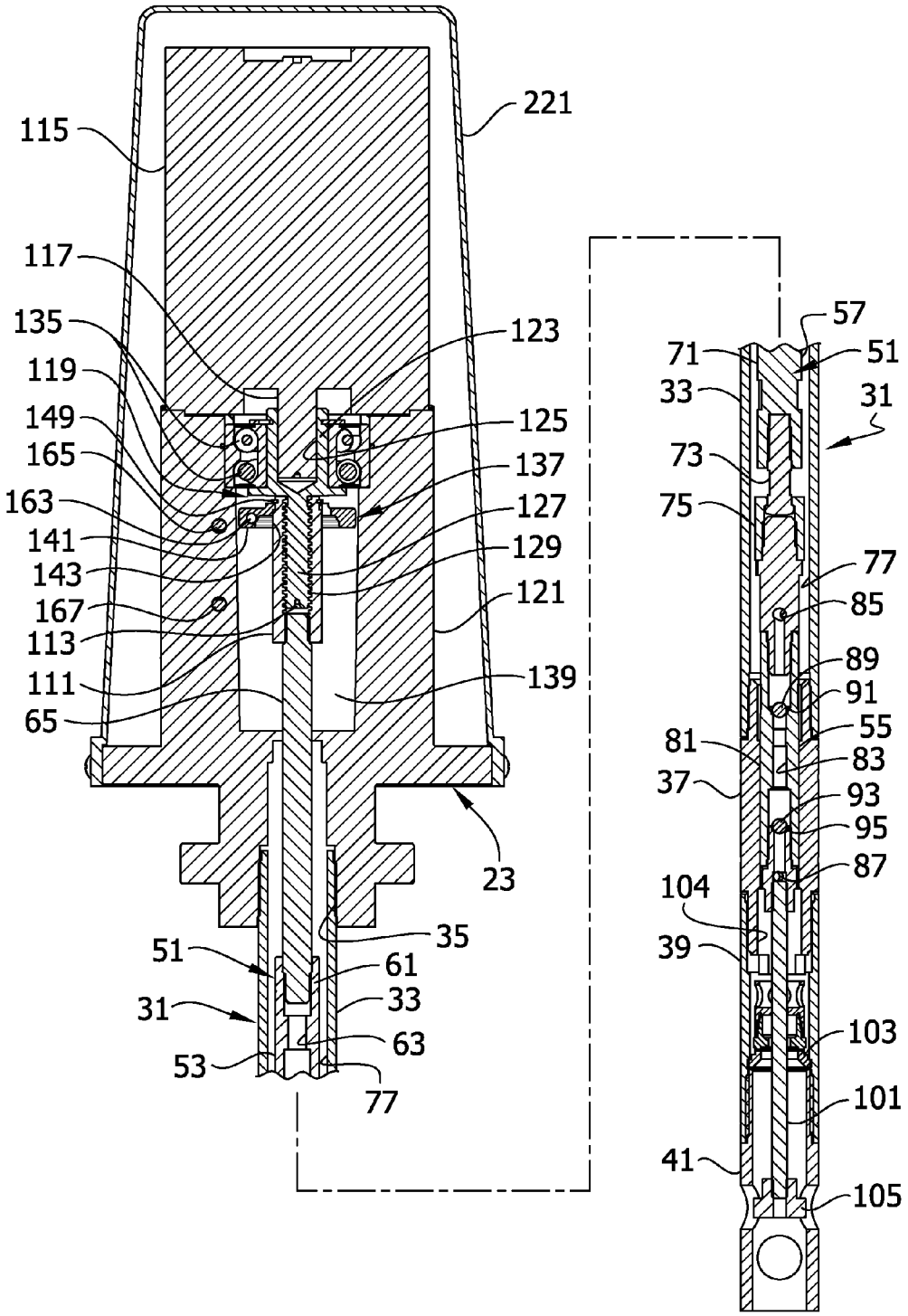
FIG. 6 is a detail of FIG. 4 showing a pump core in a raised position.

As shown in FIGS. 4-6, the upper end portion 53 of the core 51 comprises a relatively short tubular element 61 having a bore 63 extending from its lower end to its upper end. The upper end of the tubular element 61 is connected to a lower end of a piston rod 65. The tubular element 61 has an outer diameter less than the outer diameter of the piston rod 65. The piston rod 65 extends from a lower end connected to the tubular element 61 through the bore 35 of the body 23 to an upper end connected to a drive mechanism, as will be explained in further detail below. The lower end of the tubular element 61 is connected to the intermediate portion 57 of the elongate core 61, such as by threaded connection. The intermediate portion 57 of the pump core 51 comprises an elongate solid cylindrical core member or rod 71 considerably longer than the tubular element 61. A lower end of the solid core member 71 comprises a stem 73 and a sleeve 75 attaching the stem to an upper end of the lower end portion 55 of the pump core 51. The tubular element 61 and the solid core member 71 are both received in the upper tubular member 33 of the pump tube 31. An annular upper chamber 77 is defined between the pump tube 31 and the pump core 51. Particularly, in the illustrated embodiment, the annular upper chamber 77 is defined between the upper tubular member 33 and the pump core 51. The annular upper chamber 77 is in fluid communication with the outlet passage 43 to facilitate dispensing liquid, as described below.

The lower end portion 55 of the pump core 51 comprises a plunger 81 slidingly and sealingly received in the intermediate tubular member 37. The plunger 81 includes a longitudinal passage 83 extending between an upper lateral passage 85 and a lower lateral passage 87. A check valve ball 89 is located below the upper lateral passage 85 and rests in a seat 91. Another check valve ball 93 is located above the lower lateral passage 87 and rests in a seat 95. A shovel rod 101 extends downward from the lower end of the plunger 81 through a priming or inlet check valve 103 located in the tubular extension member 39 and into the priming tube 41. The space between the seat of the inlet check valve 103 and the lower end of the pump core 51 defines a lower chamber 104. The shovel rod 101 is slidable with respect to the inlet check valve 103. A shovel 105 is attached to a lower end of the shovel rod 101 and is configured for reciprocating movement with the shovel rod within the priming tube 41.

As will be described hereinafter, the upper and lower chambers 77, 104 are expansible and contractible chambers which expand and contract during upstrokes and downstrokes of the piston rod 65 and pump core 51. (The lower chamber 104 contracts and the upper chamber 77 expands during a downstroke; the lower chamber expands and the upper chamber contracts during an upstroke.) As a result, fluid is delivered through the outlet passage 43 during both upstrokes and downstrokes of the pump.

Figure 7:
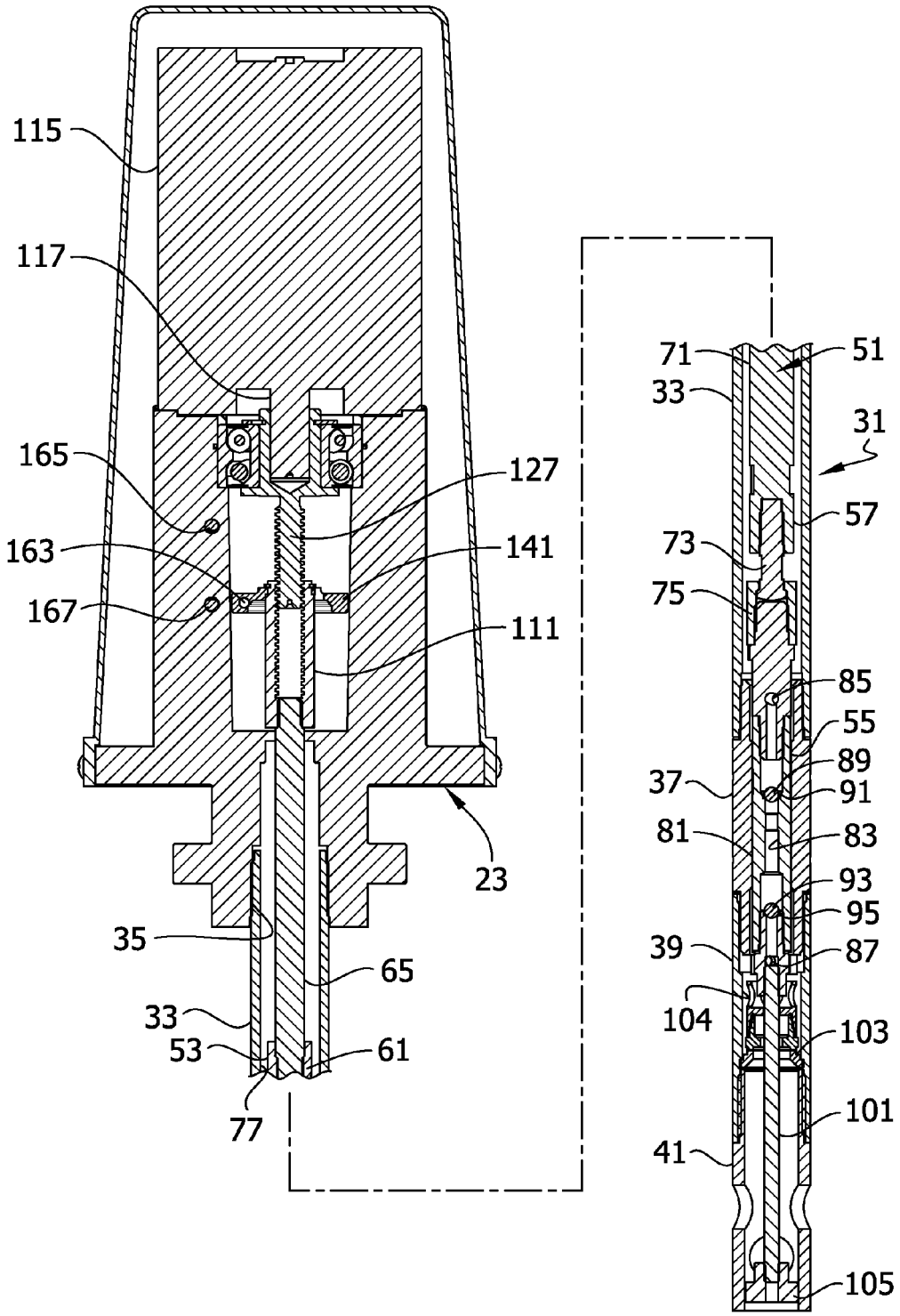
FIG. 7 is a detail of FIG. 5 showing a pump core in a lowered position.

A motor-driven transmission, indicated generally at 109, is mounted on the body 23 for reciprocating the pump core 51 through a pump stroke. The transmission 109 reciprocates the pump core 51 between a raised position relative to the fixed pump tube 31 and a lowered position relative to the pump tube. The pump core 51 moves toward the raised position during an upstroke, as illustrated in FIGS. 4, 6, and 8, and moves toward the lowered position during a downstroke, as illustrated in FIGS. 5, 7, and 9.

As illustrated in FIGS. 6-9, the piston rod 65 is attached to an upper end of the pump core 51 and to a lower end of a hollow cylindrical piston body 111 opposite the pump core. The piston body 111 has internal threads 113 extending from generally adjacent the upper end of the body toward the lower end of the body, but desirably terminating short of the lower end.

The pump core 51 is movable through up and down pumping strokes by reciprocating movement of the piston rod 65. The piston rod 65 is movable in a reciprocating manner by a linear position drive mechanism comprising a stepper motor 115 having a vertical output shaft 117 connected to a co-axial lead screw, generally designated by 119, rotatable in a follower housing portion 121 of the body 23. The lead screw 119 comprises a lead screw body 123 having a bore 125 that receives the output shaft 117 of the stepper motor 115, and a threaded shaft 127 extending downward from the lead screw body. The shaft 127 has external threads 129 configured to mate with the internal threads 113 of the piston body 111. The stepper motor output shaft 117 engages the body 123 of the lead screw (e.g., with a spline connection) so that the shaft and the lead screw turn in unison. Desirably, the mating threads on the piston body and lead screw are constructed for the efficient transmission of power. By way of example, the threads 113, 129 may be full ACME threads capable of carrying a substantial load for pumping liquid at high pressures. Thrust loads exerted on the piston and the lead screw are carried by angular contact bearings 135. The angular contact bearings 135 support loads in both directions, i.e., during both the upstroke and the downstroke.

A follower, generally designated by 137, is secured to the piston body 111 for back and forth linear movement of the follower and the piston body in a cavity 139 in the follower housing portion 121 of the body 23. The longitudinal centerline of the cavity 139 is generally co-axial with the longitudinal centerlines of the piston body 111 and the lead screw 119. The longitudinal centerline of the cavity 139 is also co-axial with the longitudinal centerline of the piston rod 65 and the bore 35 extending through the hollow body 23. The piston rod 65 extends from a location within the cavity 139 through the bore 35 and into the pump tube 31.

The follower 137 comprises a follower body 141 having a central opening 143 that receives an upper end portion of the piston body 111. Desirably, the follower body 141 has a non-circular peripheral shape conforming to a non-circular cross-sectional shape of the cavity 139 to prevent rotational movement of the follower as it reciprocates in the cavity. The central opening 143 of the follower bore and the upper end portion of the piston body 111 can be non-circular in shape (e.g., rectangular) to prevent relative rotational movement between the piston and the follower. The follower 137 is held in place against a shoulder on the piston body 111 by a retaining clip 149. Other constructions may be used to prevent relative rotation and linear movement between the piston and the follower without departing from the scope of the present invention. Rotation of the motor output shaft 117 and lead screw 119 in one direction causes the piston rod 65 to move linearly in the bore 35 through a pumping upstroke, and rotation of the output shaft and lead screw in the opposite direction causes the piston rod to move linearly in the bore through a pumping downstroke. The lengths of the pumping upstrokes and downstrokes are controlled by operation of the stepper motor 115, which is under the control of a control, as will be described further below. Desirably, the cavity 139 functions as a reservoir for holding a lubricant (e.g., oil) suitable for lubricating the threads 113, 129 on the piston body 111 and the lead screw 119.

A calibration mechanism generally designated 161 is provided for calibrating operation of the stepper motor 115 relative to the position of the piston body 111 in the cavity 139. In the illustrated embodiment, this mechanism 161 comprises a magnet 163 on the follower 137 movable with the piston body 111, and at least one and desirably two magnetic field sensors 165, 167 mounted on the follower housing portion 121 at spaced-apart locations corresponding to the piston movement. The control receives signals from the calibration mechanism 161 and calibrates operation of the stepper motor relative to the position of the piston.

The pump body 23 can be contained in a housing 221. Furthermore, as illustrated in FIGS. 8 and 9, a control 291 is provided in or on the housing 221 for controlling operation of the stepper/servo motor 115. In particular, the control 291 is a microprocessor custom made by Lincoln Industrial Corporation of St. Louis, Mo., and is adapted to control a speed and direction of rotation of the output shaft 117 of the motor 115. As will be appreciated by those skilled in the art, the control 291 operates to change the flow rate of lubricant being pumped from the supply R. A pressure transducer 293 (broadly, a pressure monitor) mounted in the plug 49 is operatively connected by an electrical lead 295 to the control 291. In one embodiment, the transducer is a No. 846F-A-6000-00 available from Hydac Technology Corporation of Bethlehem, Pa. The transducer 293 communicates with the bore of the outlet passage 43 to measure pressure in the bore. When pressure of fluid in the bore is outside a predetermined range, the control 291 adjusts the speed of the motor 115 to adjust the flow rate of lubricant being pumped and thereby adjust the pressure of fluid in the bore of the outlet passage 43. For example, when the pressure falls below the predetermined range, the control 291 increases the speed of the motor 115 to increase the flow rate of lubricant, thereby increasing the pressure of fluid in the bore of the outlet passage 43. Although the control 291 may operate to maintain the pressure of lubricant in the bore to be within other predetermined ranges, in one embodiment the control maintains the pressure to be within a range of about 1000 psi to about 5000 psi. As will be appreciated by those skilled in the art, the control 291 can control system pressures to be within good design limits.

To begin an upstroke, the control operates the stepper motor 109 to rotate its output shaft 117 in one direction, causing the piston rod 65 and pump core 51 to move upward from the position shown in FIG. 7 to the position shown in FIG. 9. As the pump core 51 rises, the lower chamber 104 expands to draw fluid from the reservoir R through the openings 42 in the priming tube 41, past the shovel 105, and up into the lower chamber. During this movement, the check valves 89, 93 remain closed, and the volume of the upper chamber 77 decreases to force an amount of fluid in that chamber through the outlet passage 43. (The decrease in volume is due to the fact that the relatively smaller diameter piston rod 65 moves up out of the upper chamber 77.) In the illustrated embodiment, the plunger 81 has a diameter of about 0.5 inch. Although the piston rod 65 may have other diameters without departing from the scope of the present invention, in one embodiment the piston rod has a diameter of about 0.385 inch, resulting in an effective cross-sectional area above the plunger 81 of about 0.0799 square inches. Thus, the amount of lubricant forced out of the upper chamber 77 through the outlet passage 43 equals the effective cross-sectional area above the plunger 81 (i.e., 0.0799 square inches in the illustrated embodiment) times the stroke length.

Upon completion of an upstroke, the control signals the stepper motor 115 to reverse direction, causing the piston rod 65 and pump core 51 to move through a downstroke. As the pump core 51 moves in a downward direction from the position shown in FIG. 9 to the position shown in FIG. 7, the volume of the lower chamber 104 decreases. Because the priming check valve 103 has a sealing fit with the shovel rod 101, the priming check valve closes as the volume of the lower chamber 104 decreases. As the volume of the lower chamber 104 decreases, fluid within that chamber is forced up past the check valves 89, 93 and into the upper chamber 77 via the longitudinal plunger passage 83 and the lateral passages 85, 87. The fluid entering the upper chamber 77 from the lower chamber 104 causes an amount of fluid to move from the upper chamber 77 out through the outlet passage 43. Although the shovel rod 101 may have other diameters without departing from the scope of the present invention, in one embodiment the shovel rod has a diameter of 0.184. Thus, the effective cross-section area below the plunger 81 is about 0.1698 square inches or a little more than twice the area above the plunger. As will be apparent to those skilled in the art, the amount of lubricant pushed out of the lower chamber 104, past the check valves 89, 93 and into the upper chamber 77 equals the effective cross-sectional area below the plunger 81 (i.e., 0.1698 square inches in the illustrated embodiment) times the stroke length or about twice as much as lubricant as forced out of the upper chamber 77 through the outlet passage 43 during the upstroke. The fluid entering the upper chamber 77 during the downstroke causes an amount of fluid to move from the upper chamber 77 out through the outlet passage 43. In the illustrated embodiment, the amount of lubricant pushed from the upper chamber 77 through the outlet passage 43 during the downstroke equals the difference in the effective cross-sectional areas above and below the plunger 81 times the stroke length or about the same amount of lubricant as pushed through the outlet passage during the upstroke. Accordingly, regardless of whether the motor 115 is moving the piston rod 65 through the upstroke or downstroke, about the same amount of lubricant is pushed through the outlet passage 43.

Providing the same amount of lubricant during each stroke enables the pump to be used to meter predetermined measured quantities of lubricant. For example, if particular circumstances necessitate delivering a quantity of lubricant equal to that delivered by one stroke of the piston rod 65, the control 291 signals motor 115 to drive the piston rod through one stroke. If twenty times that quantity is desired, the control signals the motor to operate through twenty strokes to deliver the increased amount.

Figure 10:
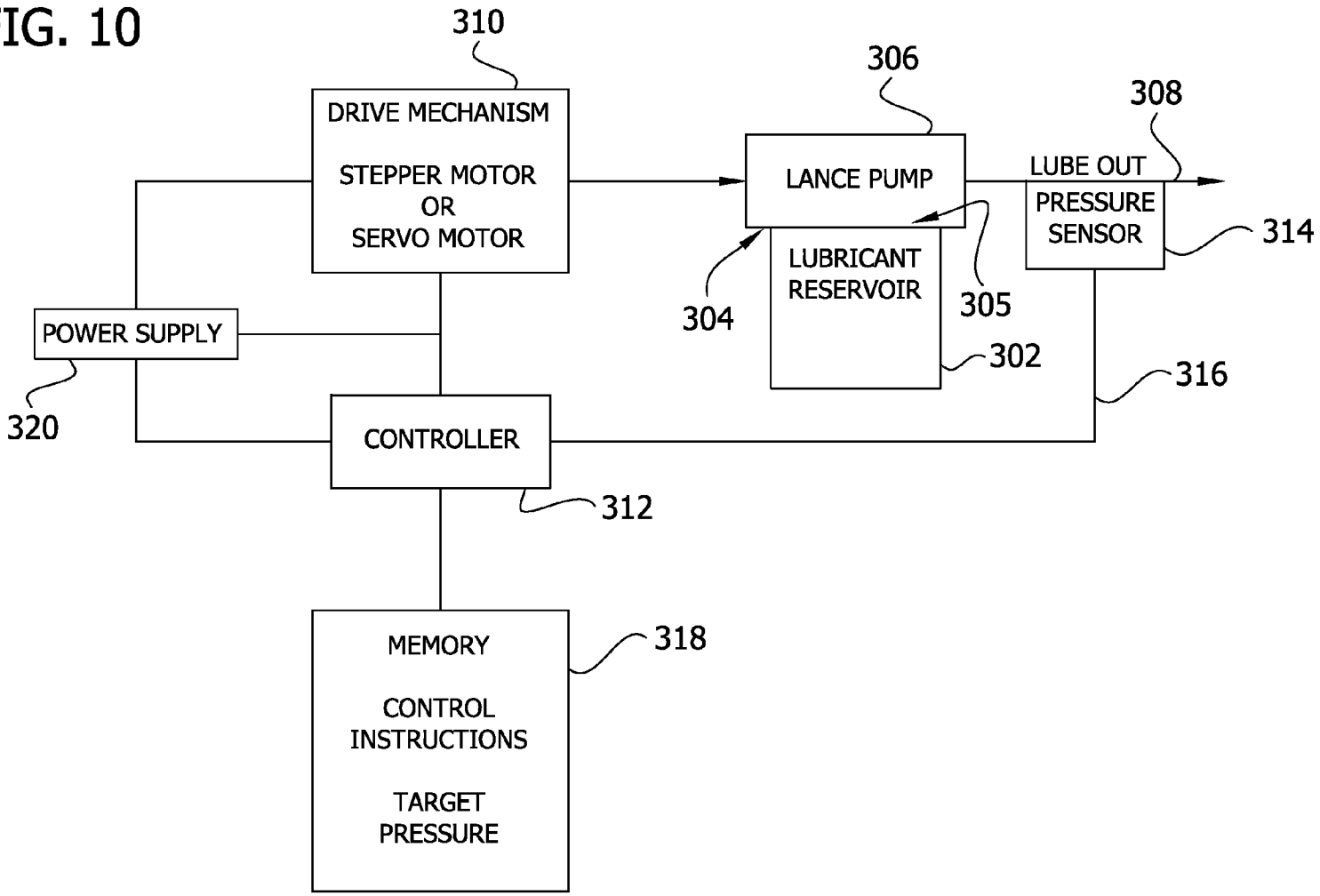
FIG. 10 is a block diagram illustrating a control controlling a motor such as a servo motor or a stepper motor driving a lance pump according to one embodiment of the invention.
Figure 11:
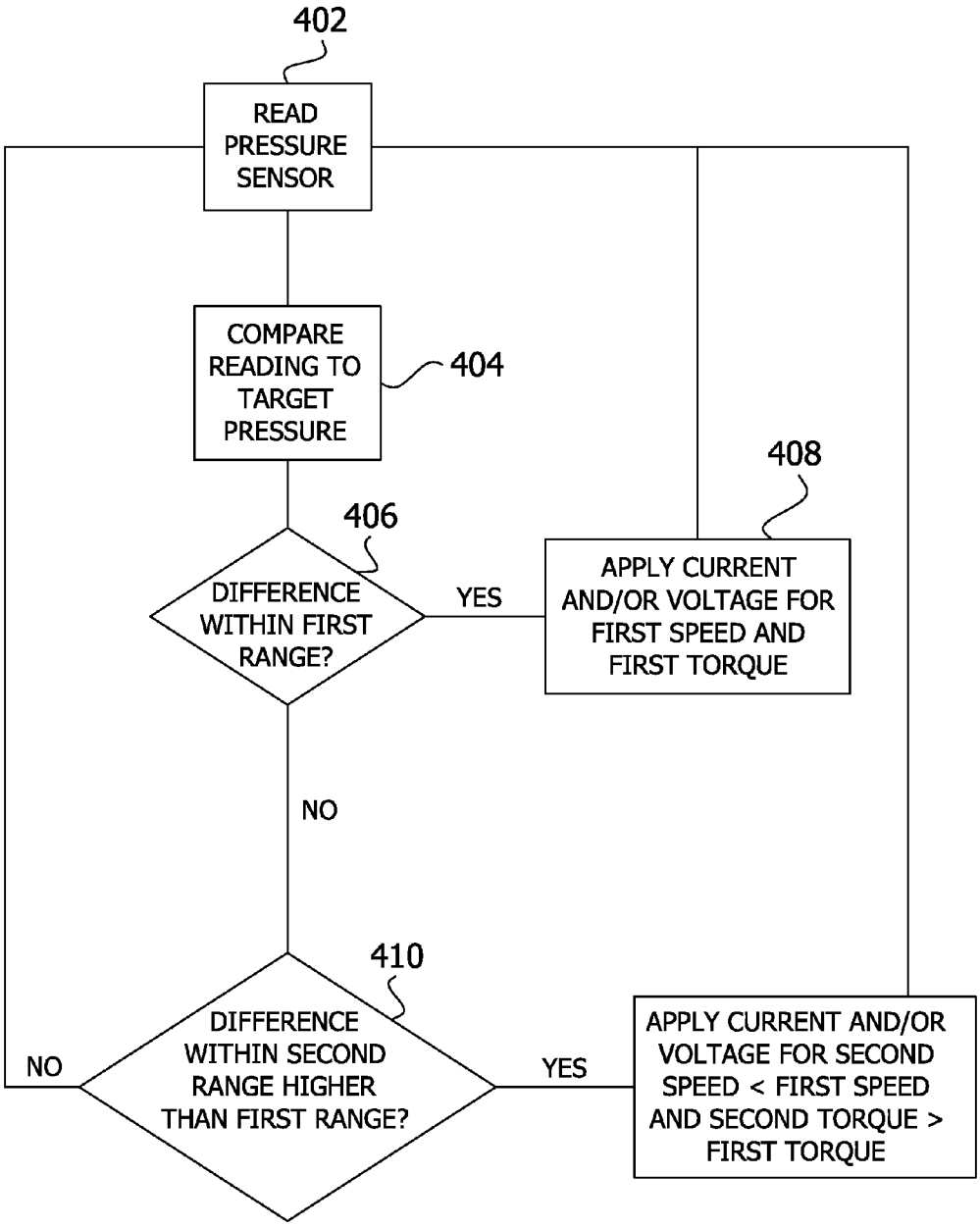
FIG. 11 is a flow chart illustrating operation of a control controlling a motor such as a servo motor or a stepper motor driving a lance pump according to one embodiment of the invention.

FIG. 10 is a block diagram illustrating a control 312 controlling a drive mechanism 310 such as a servo motor or a stepper motor driving a lance pump 306 according to one embodiment of the invention. (By way of example, the lance pump 306 may be identical or similar to the lance pump 21 described above.) FIG. 11 is a flow chart illustration operation of the control.

Referring to FIG. 10, a reservoir 302 holds lubricant and has a reservoir outlet 304 in communication with an input 305 to the lance pump 306, which has an output 308 in communication with a system (not shown) requiring lubricant. The drive mechanism 310 includes a motor such as a stepper motor or a servo motor for driving the lance pump. The control 312 controls the operation of the motor by selectively varying a current or a voltage applied to the motor to control a speed and/or a torque of the motor to drive the lance pump 306 to dispense lubricant via its output to the system. A pressure sensor 314 (e.g., similar to the pressure sensor 49 of the pump 21 described above) senses a pressure condition at the output of the lance pump 306 and provides a pressure condition signal 316 indicative of the pressure condition. The control 312 is responsive to the pressure condition signal 316 and selectively varies the current or the voltage applied to the motor to vary the speed and/or the torque of the motor as a function of a difference between the pressure condition signal 316 and a target pressure condition stored in a tangible, non-transitory memory 318. The memory also stores software control instructions executed by the control which may include a processor in one embodiment.

In an embodiment in which the motor comprises a stepper motor, the control 312 selectively applies PWM (pulse width modulated) pulses via a power supply 320 to the stepper motor to vary speed and torque of the stepper motor as a function of the target pressure condition compared to the sensed pressure condition.

In one embodiment, the 312 applies PWM pulses to the stepper motor such that the speed of the stepper motor is a first speed and a first torque when the pressure signal is within a first range. In addition, the control 312 applies PWM pulses to the stepper motor such that the speed of the stepper motor is a second speed less than the first speed and at a second torque greater than the first torque when the pressure signal is within a second range higher than the first range.

In one embodiment, the motor comprises a servo motor and the control 312 selectively applies a varying voltage to the servo motor to vary the speed of the servo motor as a function of the target pressure condition compared to the sensed pressure condition.

For example, the control 312 may apply a voltage and/or current to the servo motor such that the speed of the servo motor is a first speed and at a first torque when the pressure signal is within a first range, and the control 312 applies a voltage and/or current to the servo motor such that the speed of the servo motor is a second speed less than the first speed and at a second torque greater than the first torque when the pressure signal is within a second range higher than the first range.

Figure 12:
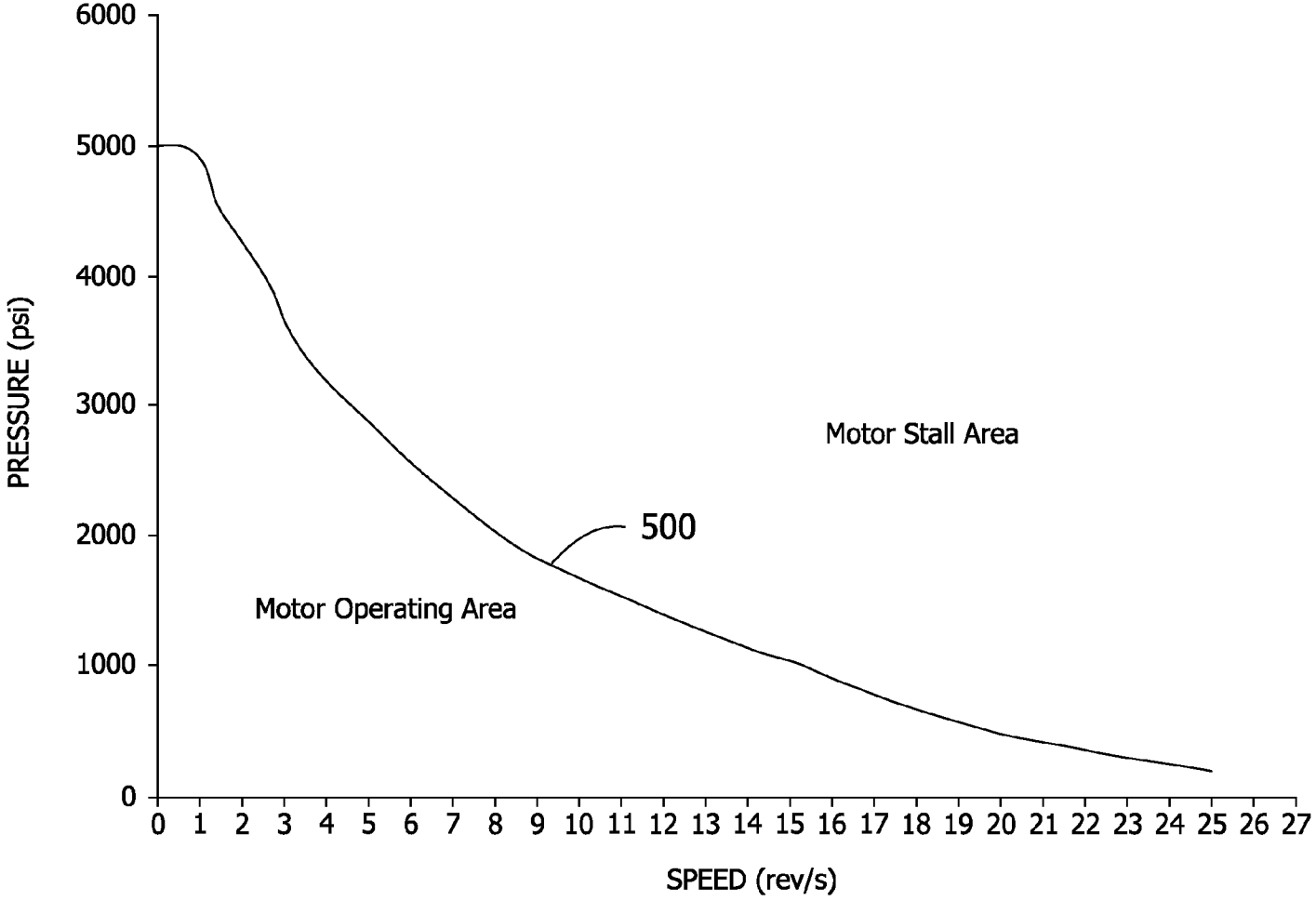
FIG. 12 is a graph illustrating pressure in psi vs. speed in rpm of a stall curve of the motor.

It is also contemplated as an alternative that a profile as illustrated in FIG. 12 or an algorithm for controlling the speed or torque of the motor may be stored in the memory 318 and that the control 312 controls the speed or torque of the motor as a function of the profile or algorithm. In one embodiment, the target pressure stored in memory 318 is 4000 PSI and the control instructions in the memory 318 are executed by the control to maximize the lubricant flow and pressure at or below 4000 PSI without stalling the motor. For example, the motor speed (voltage) would be operated as fast as possible and/or the motor current with as much torque as possible without stalling the motor and without saturating the motor stator (e.g., the motor is operated below its stall curve 500 illustrated in FIG. 12). As the pressure increases, the speed of the motor would be decreased and the torque of the motor would be increased. In addition, the motor is operated such that the motor temperature is maintained within its operating range.

When the drive mechanism 310 includes a stepper motor, one embodiment includes control instructions in memory 318 executed by control 312 resulting in the frequency of PWM pulses applied to the stepper motor decreasing and the pulse width increasing to decrease speed and increase torque as the pressure of the lubricant increases, as indicated by pressure signal 316. The frequency of the pulses applied to the stepper motor would be maintained above a minimum and the width of the pulses would be maintained below a maximum to prevent stalling and to minimize motor temperature. When the drive mechanism 310 includes a servo motor, one embodiment includes control instructions in memory 318 executed by control 312 resulting in decreasing the voltage applied to the servo motor and increasing the current applied to the servo motor as the pressure increases. The servo motor may have an encoder which provides feedback to the control 312 indicative of the speed of the servo motor. The voltage applied to the servo motor would be maintained above a minimum and the current applied would be maintained below a maximum to prevent stalling and to maintain the motor temperature within its operating range.

FIG. 11 illustrates one embodiment of a method for supplying lubricant to a system and illustrates one embodiment of software instruction stored in memory 318. The method includes providing a reservoir 302 for holding lubricant. A lance pump 306 having an input 305 in communication with a reservoir outlet 304 and having an output 308 in communication with the system is also provided. A drive mechanism 310 including a motor comprising a variable speed motor, such as a stepper motor or a servo motor, drives the lance pump 306. The operation of the motor is controlled by selectively varying the current or voltage applied to the motor to control a speed and/or a torque of the motor to drive the lance pump 306 to dispense lubricant via its output 308 to the system. A pressure condition at the output 308 of the lance pump 306 is sensed at 402 and compared at 404 a pressure condition signal 316 indicative of the pressure condition. The current or voltage applied to the motor is selectively varied to vary the speed and/or the torque of the motor as a function of a difference between the pressure condition signal 316 and a target pressure condition stored in memory 318.

When the motor comprises a stepper motor, PWM pulses are selectively applied to the stepper motor to vary speed and torque of the stepper motor as a function of the target pressure condition compared to the sensed pressure condition.

In one embodiment, when a difference between the sensed pressure at 402 compared to the target pressure at 404 is within a first range at 406, the PWM pulses are applied to the stepper motor at 408 such that the stepper motor is at a first speed and at a first torque. When the difference at 410 is within a second range higher than the first range, PWM pulses are applied to the stepper motor at 412 such that the stepper motor is at a second speed less than the first speed and at a second torque greater than the first torque.

When the motor comprises a servo motor, the control 312 selectively applies a varying voltage to the servo motor to vary speed of the servo motor as a function of the target pressure condition stored in memory 318 compared to the sensed pressure condition 316. In particular, a voltage is applied to the servo motor such that the speed of the servo motor is a first speed and at a first torque when the pressure signal is within a first range, and a voltage to the servo motor such that the speed of the servo motor is a second speed less than the first speed and at a second torque greater than the first torque when the pressure signal is within a second range higher than the first range.

As a result of the motor operation as described above, the pressure of lubricant supplied to a system via output 308 is ramped up and maintained close or slightly below the target pressure stored in memory 318. Simultaneously, the volume of lubricant pumped over time is decreased as the pressure increases to avoid excessive pressure and to minimize the release of lubricant via a safety or relief valve of the system. This inhibits excessive back pressure, minimizes motor stalls and promotes more lubricant to be quickly and effectively supplied to the system. As a result, the system and its components are effectively lubricated and the risk of failure due to improperly lubricated components of the system is minimized.

As will be appreciated by those skilled in the art, the lance pump 21 described above has several advantages over many prior commercially available lance pumps. Because the lance pump 21 is driven by a stepper motor capable of turning its output shaft at variable speeds, the output pressure and flow rate provided by the pump can be varied to conform to demand or specific operating conditions and environments. The lance pump is capable of providing viscous liquids at desired pressures on demand. Further, because the motor can run at lower speeds, complicated reduction gearing such as found in some prior commercial lance pumps can be eliminated. It is envisioned that by eliminating the reduction gearing, the cost and complexity of the lance pump may be reduced compared to lance pumps having reduction gearing.

As will be appreciated by those skilled in the art, the lance pump described above may be used in place of other types of lubricant pumps such as those described in U.S. patent application Ser. No. 13/271,862 filed Oct. 12, 2011, entitled, "Pump having Stepper Motor and Overdrive Control," which is incorporated by reference. In such an application the pump can be to provide substantial lubricant flow (e.g., 150 cc/min) during system start up when pressures are low (e.g., 0 psi) and reduced flow after start up (e.g., 10 cc/min) when lubricant pressures are higher (e.g., 5000 psi).

As will also be appreciated by those skilled in the art, the motor may be a servo motor rather than a stepper motor and the control can be modified accordingly.

Having described the invention in detail, it will be apparent that modifications and variations are possible without departing from the scope of the invention defined in the appended claims.

When introducing elements of the present invention or the preferred embodiments(s) thereof, the articles "a", "an", "the", and "said" are intended to mean that there are one or more of the elements. The terms "comprising", "including", and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A pressure controlled pump for pumping a viscous liquid from a reservoir, said pump comprising:

a pump body adapted for positioning above said reservoir;

an elongate tube extending downward from an upper end connected to the body, past an upper portion and a lower portion, to a lower end when the body is positioned above said reservoir;

an elongate core slidably received in the tube and extending vertically downward from the body into the liquid when the body is in position above the reservoir, the core having a longitudinal axis extending between an upper end mounted on the body and a lower end opposite the upper end;

a stepper motor mounted on the body having a selectively rotatable output shaft extending vertically above the liquid in the reservoir when the body is in position;

a transmission operatively connected to the stepper motor output shaft for effecting reciprocating relative motion between the tube and the core so the elongate core moves between a relative raised position and a relative lowered position as the stepper motor output shaft rotates in one direction to effect an upward pumping stroke and in an opposite direction to effect a downward pumping stroke;

an inlet check valve mounted inside the tube defining with the tube an expansible and contractible lower pump chamber, the inlet check valve being oriented to open during each upward pumping stroke permitting viscous liquid to enter said lower pump chamber;

an annular upper chamber defined in part by the tube and the core above the lower pump chamber and having a cross-sectional area half as large as that of said lower pump chamber;

a lateral passage in the core connecting the lower pump chamber to the annular upper chamber having a check valve oriented to open during each downward pumping stroke;

an outlet passage connected to the annular upper chamber so viscous liquid flows from the annular upper chamber and through the outlet passage during each upward pumping stroke and each downward pumping stroke;

a pressure monitor in fluid communication with liquid in the outlet passage for measuring pressure of said liquid; and a control operatively connected between the pressure monitor and the stepper motor for controlling operation of the stepper motor in response to a signal from the pressure monitor, the control adjusting stepper motor output shaft speed in response to the signal from the pressure monitor, said control controlling operation of the stepper motor to deliver a predetermined quantity of viscous liquid through the outlet by effecting a selected number of upward pumping strokes and downward pumping strokes, said control thereby delivering the predetermined quantity of viscous liquid at a preselected pressure.

2. A pump as set forth in claim 1, wherein the control adjusts output shaft speed to maintain pressure sensed by the pressure monitor to be in a range from about 1000 psi to about 5000 psi.

3. A pump as set forth in claim 1, wherein:

the transmission operatively connects the stepper motor output shaft and the elongate core; and the transmission reciprocates the core between a raised position and lowered position.

4. A pump for pumping a viscous liquid from a reservoir, said pump comprising:

a pump body adapted for positioning above said reservoir;

an elongate tube extending downward from an upper end connected to the body to a lower end below the upper end when the body is positioned above said reservoir;

an elongate core slidably received in the tube and extending vertically downward from the body into the liquid when the body is in position above the reservoir, the core having a longitudinal axis extending between an upper end mounted on the body and a lower end opposite the upper end;

an electric stepper motor mounted on the body having a selectively rotatable output shaft for effecting relative reciprocating motion between the core and the elongate tube so the core moves between a relative raised position and a relative lowered position as the motor output shaft rotates in one direction to effect an upward pumping stroke and in an opposite direction to effect a downward pumping stroke;

a control operatively connected to the electric stepper motor for controlling operation of the motor, said control adjusting stepper motor output shaft speed in response to at least one characteristic of liquid in the pump, said control controlling operation of the stepper motor to deliver a predetermined quantity of viscous liquid through the outlet by effecting a selected number of upward pumping strokes and downward pumping strokes, said control thereby delivering the predetermined quantity of viscous liquid having the at least one characteristic;

an inlet check valve mounted inside the tube defining with the tube an expansible and contractible lower pump chamber, the inlet check valve being oriented to open during each upward pumping stroke permitting viscous liquid to enter said lower pump chamber;

an annular upper chamber defined in part by the tube and the core above the lower pump chamber and having a cross-sectional area half as large as that of said lower pump chamber;

a lateral passage in the core connecting the lower pump chamber to the annular upper chamber having a check valve oriented to open during each downward pumping stroke to deliver viscous liquid from the lower pump chamber to the annular upper chamber; and an outlet passage connected to the annular upper chamber permitting viscous liquid to flow from the annular upper chamber.

5. A pump as set forth in claim 4, wherein the control adjusts output shaft speed in response to at least one characteristic of liquid in the pump selected from a group of characteristics consisting of pressure and flow rate.

6. A pump as set forth in claim 5, wherein the control adjusts output shaft speed in response to liquid pressure in the pump.

7. A pump as set forth in claim 6, further comprising a pressure monitor in fluid communication with liquid in the pump downstream from the check valve for measuring pressure of the liquid and providing a signal to the control corresponding to the measured pressure.

8. A pump as set forth in claim 7, wherein the pressure monitor is mounted for sensing pressure of liquid in the outlet passage.

9. A pump as set forth in claim 8, wherein the control adjusts output shaft speed to maintain pressure sensed by the pressure monitor to be in a range of about 1000 psi to about 5000 psi.

10. A pump as set forth in claim 4, wherein the motor reciprocates the core between a raised position and lowered position.

* * * * *